US007426470B2

(12) United States Patent
Chu et al.

(10) Patent No.: US 7,426,470 B2
(45) Date of Patent: Sep. 16, 2008

(54) ENERGY-BASED NONUNIFORM TIME-SCALE MODIFICATION OF AUDIO SIGNALS

(75) Inventors: Wai C. Chu, San Jose, CA (US); Khosrow Lashkari, Fremont, CA (US)

(73) Assignee: NTT Docomo, Inc., Tokyo (JP)

( * ) Notice: Subject to any disclaimer, the term of this patent is extended or adjusted under 35 U.S.C. 154(b) by 781 days.

(21) Appl. No.: 10/264,042

(22) Filed: Oct. 3, 2002

(65) Prior Publication Data

US 2004/0068412 A1 Apr. 8, 2004

(51) Int. Cl.
*G10L 21/04* (2006.01)

(52) U.S. Cl. ..... 704/503; 704/500; 370/521

(58) Field of Classification Search ..... 704/503, 704/500, 267; 375/240.23; 370/470, 521
See application file for complete search history.

(56) References Cited

U.S. PATENT DOCUMENTS 5,341,432 A * 8/1994 Suzuki et al. ..... 704/211
5,630,013 A * 5/1997 Suzuki et al. ..... 704/216
5,717,823 A * 2/1998 Kleijn ..... 704/220
5,744,742 A * 4/1998 Lindemann et al. ..... 84/623
5,828,955 A * 10/1998 Lipowski et al. ..... 455/324
5,828,994 A * 10/1998 Covell et al. ..... 704/211
5,893,062 A * 4/1999 Bhadkamkar et al. ..... 704/270
5,920,840 A * 7/1999 Satyamurti et al. ..... 704/267
6,484,137 B1 * 11/2002 Taniguchi et al. ..... 704/211
6,490,553 B2 * 12/2002 Van Thong et al. ..... 704/211
6,625,655 B2 * 9/2003 Goldhor et al. ..... 709/231
6,718,309 B1 * 4/2004 Selly ..... 704/503
6,763,329 B2 * 7/2004 Brandel et al. ..... 704/207
6,801,898 B1 * 10/2004 Koezuka ..... 704/500
6,944,510 B1 * 9/2005 Ballesty et al. ..... 700/94
7,065,485 B1 * 6/2006 Chong-White et al. ..... 704/208
7,171,367 B2 * 1/2007 Chang ..... 704/503
7,363,232 B2 * 4/2008 Megeid et al. ..... 704/503

OTHER PUBLICATIONS

Chang, Shih-Fu et al., Chapter 20 "Multimedia Search and Retrieval", *Multimedia Systems, Standards and Networks*, Marcel Dekker, Inc. publishers, copyright 2000, pp. 559-584.

Covell, Michele et al., "MACH1: Nonuniform Time-Scale Modification of Speech", *IEEE*, 1998, pp. 349-352.

George, E. Bryan, et al., "Speech Analysis/Synthesis and Modification Using an Analysis-by-Synthesis/Overlap-Add Sinusoidal Model", *IEEE Transactions on Speech and Audio Processing*, vol. 5, No. 5, Sep. 1997, pp. 389-406.

(Continued)

*Primary Examiner*—Martin Lerner
(74) *Attorney, Agent, or Firm*—Blakely, Sokoloff, Taylor & Zafman LLP

(57) ABSTRACT

A method for energy based, non-uniform time-scale compression of audio signals includes receiving a frame of data corresponding to an input audio signal and segmenting the data into a plurality of segments. The method further includes estimating a value related to energy of the frame of data, determining a peak energy estimate for the frame, determining an energy threshold based on the peak energy estimate of the frame and comparing the value related to energy of the frame of the data with the energy threshold to control time-scale compression of the audio data.

8 Claims, 3 Drawing Sheets

| Time-scale ratio (ρ) | Prefer uniform compression | No preference | Prefer nonuniform compression |
|---|---|---|---|
| 0.5 | 38 | 44 | 18 |
| 0.4 | 25 | 35 | 40 |
| 0.3 | 30 | 10 | 60 |
| 0.2 | 29 | 0 | 71 |
| 0.1 | 14 | 0 | 86 |

OTHER PUBLICATIONS

Hardam, E., "High Quality Time Scale Modification of Speech Signals Using Fast Synchronized-Overlap-Add Algorithms", *IEEE*, 1990, pp. 409-412.
He, Liwei et al., "User Benefits of Non-Linear Time Compression", *Technical Report MSR-TR-2000-96*, Microsoft Research, Microsoft Corporation, 2000, 9 pages.
Laroche, Jean et al., "Improved Phase Vocoder Time-Scale Modification of Audio", *IEEE Transactions On Speech and Audio Processing*, vol. 7. No. 3, 1999, pp. 323-332.
Lee, Sungjoo et al., "Variable Time-Scale Modification of Speech Using Transient Information", *IEEE*, 1997, pp. 1319-1322.
McAulay, Robert J. et al., "Speech Analysis/Synthesis Based On A Sinusoidal Representation", *IEEE Transactions On Acoustics, Speech, and Signal Processing*, vol. 34, No. 4, 1986, pp. 744-754.
Macon, Michael W. et al., "Sinusoidal Modeling and Modification of Unvoiced Speech", *IEEE Transactions on Speech and Audio Processing*, vol. 5, No. 6, 1997, pp. 557-560.
Portnoff, Michael, "Time-Scale Modification of Speech Based On Short-Time Fourier Analysis", *IEEE Transactions On Acoustics, Speech, and Signal Processing*, vol. ASSP-29, No. 3, 1981, pp. 374-390.
Omoigui, Nosa et al., "Time-Compression: Systems Concerns, Usage, and Benefits", *Technical Report*, Microsoft Research, Microsoft Corporation, 1999, 8 pages.
Sanneck, H. et al., "A New Technique for Audio Packet Loss Concealment", *University of Erlangen-Nuremberg Germany, Germany*, 1996, 5 pages.
Verhelst, Werner, "An Overlap-Add Technique Based on Waveform Similarity (WSOLA) for High Quality Time-Scale Modification of Speech", *University of Brussels*, Belgium, 1993, pp. II-554-II-557.
Yim, S., Computationally Efficient Algorithm for Time Scale Modification (GLS-TSM), *IEEE*, 1996, pp. 1009-1012.

* cited by examiner

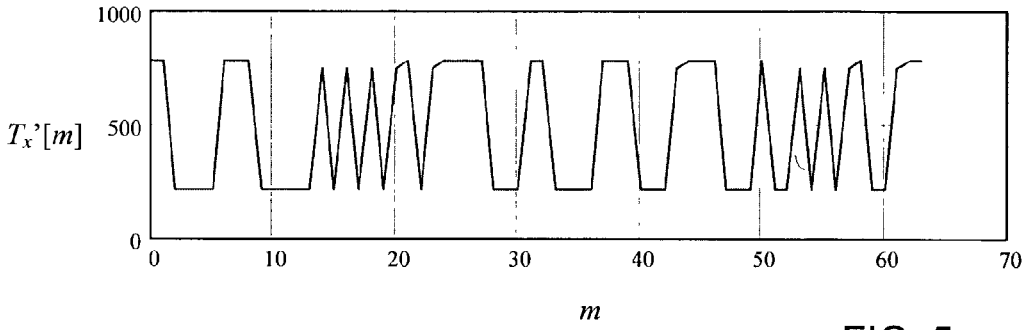
FIG. 5
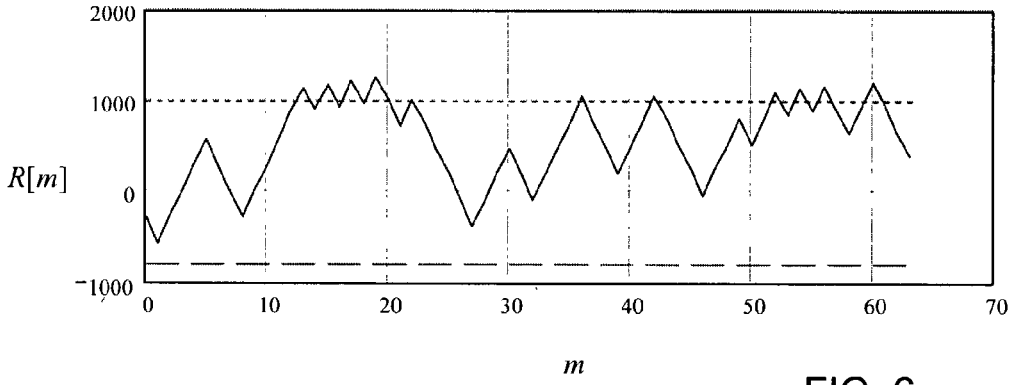
FIG. 6
| Time-scale ratio (ρ) | Prefer uniform compression | No preference | Prefer nonuniform compression |
|---|---|---|---|
| 0.5 | 38 | 44 | 18 |
| 0.4 | 25 | 35 | 40 |
| 0.3 | 30 | 10 | 60 |
| 0.2 | 29 | 0 | 71 |
| 0.1 | 14 | 0 | 86 |
FIG. 7

ENERGY-BASED NONUNIFORM TIME-SCALE MODIFICATION OF AUDIO SIGNALS

BACKGROUND

The present application relates generally to processing audio signals. More particularly, the present invention relates to energy-based, nonuniform time-scale compression of audio signals.

The purpose of time-scale modification of an audio signal is to change the playback rate of the audio signal while preserving the original audio characteristics, such as pitch perception and frequency distribution. The modified signal is perceived as being faster (time-scale compression) or slower (time-scale expansion) with respect to the original audio.

Applications for time-scale modification include telephone voicemail systems and answering machines, where message playback can be sped up or slowed down depending on user preference. More recently, multimedia search and retrieval on local sources or over networks such as the internet have provided applications for time-scale modification of audio and video signals. The technique is also useful for streaming media delivery of multimedia materials. Deployment of time-scale modification systems and methods can dramatically improve the efficiency of retrieval of audio and speech material in large-scale databases.

Many techniques have been developed in the past for time-scale modification. In general, time-scale modification techniques can be grouped as linear and non-linear algorithms. In a linear algorithm, time compression or expansion is applied consistently across the entire audio stream with a given speed-up or slow-down rate.

The most basic example is by playing the audio at a lower sampling rate than that at which it was recorded, such as by dropping alternate samples. This results, however, in an increase in pitch, creating less intelligible and enjoyable audio.

Another basic technique involves discarding portions of short, fixed-length audio segments and abutting the retained segments. However, discarding segments and abutting the remnants produces discontinuities at the interval boundaries and produces audible clicks and other audio distortion. To improve the quality of the output signal, a windowing function or smoothing filter can be applied at the junctions of the abutted segments. One such technique is called overlap and add (OLA). Another is synchronized overlap and add (SOLA). Another is waveform-similarity overlap and add (WSOLA). The OLA-type algorithms provide benefits of simplicity and efficiency. Important design considerations in algorithm design and implementation include the processor resources required for signal processing the audio signal and data storage capacity.

In non-linear time compression, the content of the audio stream is analyzed and compression rates may vary from one point in time to another. In some examples, redundancies such as pauses or elongated vowels are compressed more aggressively.

In a typical WSOLA algorithm, fixed-length segments are extracted from the input signal near the time instants n=0, $T_x$, $2T_x$, . . . , with $T_x>0$ a parameter of the algorithm. The best segments found near these time instants are overlapped and added to form the output signal. The process is shown in FIG. 2. Note that the input signal is processed at uniformly separated intervals. The time-scale ratio is defined by $$\rho=T_y/T_x \quad (1)$$

The time scale ratio ρ is less than one for time-scale compression and greater than one for time-scale expansion.

Current time scale modification algorithms do not provide adequate results in low-rate time-scale compression, for instance at $\rho<0.5$. Intelligibility of the resulting audio is too poor for commercial use. Accordingly, there is a need for an improved time-scale compression method and apparatus for audio signals.

BRIEF SUMMARY

By way of introduction only, a method for energy based, non-uniform time-scale compression of speech signals includes receiving a frame of data corresponding to an input speech signal and segmenting the data into a plurality of segments. The method further includes estimating a value related to energy of the frame of data, determining a peak energy estimate for the frame, determining an energy threshold based on the peak energy estimate of the frame and comparing the value related to energy of the frame of the data with the energy threshold to control time-scale compression of the speech data.

The foregoing summary has been provided only by way of introduction. Nothing in this section should be taken as a limitation on the following claims, which define the scope of the invention.

BRIEF DESCRIPTION OF THE DRAWINGS

FIG. 5 is a plot of input segmentation length in a time scale compression system;

FIG. 6 is a plot of reservoir content in a time scale compression system; and FIG. 7 is a table showing results of a listener preference test.

DETAILED DESCRIPTION OF THE PRESENTLY PREFERRED EMBODIMENTS

Figure 1:
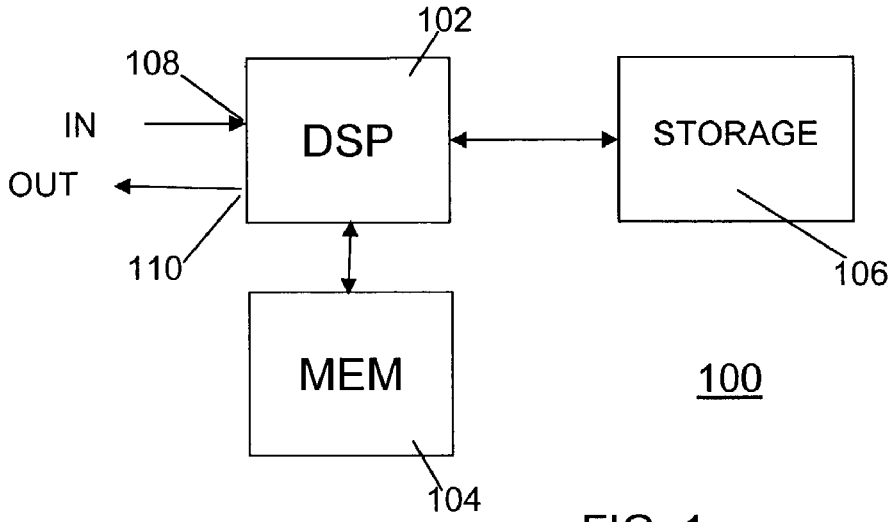
FIG. 1 is a block diagram of a audio processing system.

Referring now to the drawing, FIG. 1 is a block diagram of an audio processing system 100. The system 100 includes a processor 102, a memory 104 and data storage 106. The system 100 is exemplary of the type of audio processing system that may benefit from the disclosed time-scale modification method and apparatus. As such, the system 100 may be joined with other components to form more complex systems providing higher degrees of functionality. For example, in one embodiment, the audio processing system 100 is part of a digital voice mail system which further includes components for data communication with a network, recording components such as a microphone and playback components such as a speaker, and a user interface.

The processor 102 may be any suitable processor adapted for processing audio data. In the illustrated embodiment, the processor 102 is a digital signal processor. The processor 102 responds to stored data and instructions for processing audio data at other data received at an input 108. The memory 104 stores data and instructions for controlling the processor 102. The processor 102, under control of the instructions stored in the memory 104, implements audio processing algorithms, such as the audio compression algorithm described below, on the received data and stores processed audio data including compressed audio data, at data storage 104. Subsequently, the processor 102 processes the stored processed audio data from the data storage 104 and provides play back audio data at an output 110. In one example, the processor de-compresses or expands the stored audio data to produce data corresponding to audible signal.

In one embodiment, the processor 102 is an integrated circuit digital signal processor and the memory 104 and the data storage 106 are embodied as semiconductor integrated circuit memory devices. In other embodiments, the processor 102 may be formed from a suitably-programmed general purpose processor. In other embodiments, the functionality of the processor 102 may be combined with other circuits on a monolithic integrated circuit to provide additional levels of functionality. Also, the memory 104 and the data storage 106 may be combined in a single device with the processor 102. Any suitable read/write memory storage device may be used for the memory 104 and the data storage 106. In alternative embodiments, rather than storing the compressed audio data in the data storage 106, the data are conveyed to other components for subsequent processing or for conversion to a compressed audio signal.

Figure 2:
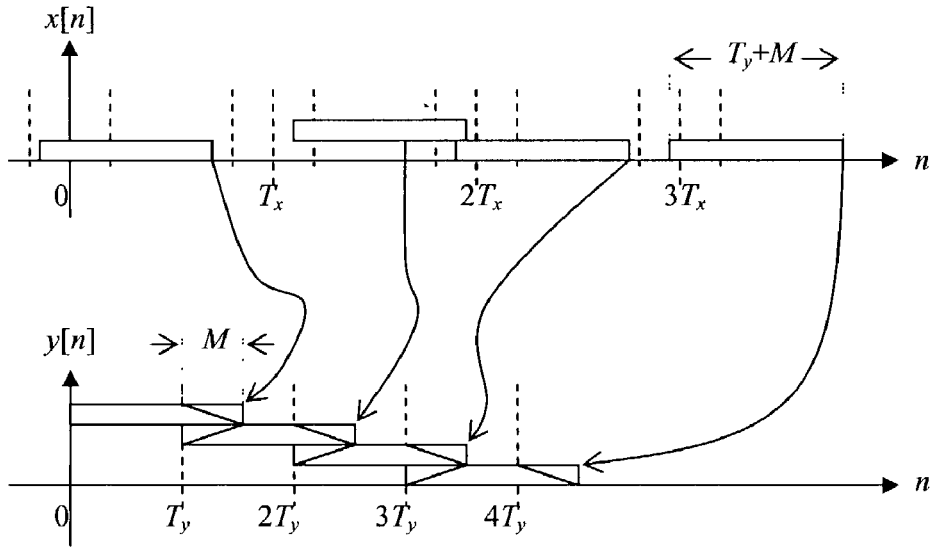
FIG. 2 illustrates uniform time scale compression.

FIG. 2 illustrates time scale compression in accordance with a waveform-similarity overlap-and-add (WSOLA) algorithm. The upper portion of FIG. 2 illustrates an input signal x(n) containing un-compressed speech. The uncompressed speech extends over several uniform time segments $T_x$. In the lower, portion of FIG. 2, after compression in a WSOLA algorithm, the output signal y(n) contains the same segments compressed together in time. The best segments found near the time instants $T_x$ are overlapped and added to form the output signal y(n). The best segments correspond to the portion of highest waveform similarity. The overlap length M defines the time duration or number of signal samples that are overlapped among adjacent segments. The output signal y(n) is divided among segments $T_y$. The time scale ratio is defined by $\rho=T_y/T_x$. The adding process between segments may be done according to simple mathematical combination or by applying scaling techniques between the adjacent segments. The algorithm of FIG. 2 may be implemented by the system 100 of FIG. 1 using a uniform time segment length.

For speech processing at a ratio of ρ near one, quality is good using the uniform approach illustrated in FIG. 2. As ρ decreases past approximately 0.5, intelligibility quickly decreases because of the longer and longer skipping between intervals, and hence the number of discarded samples grows. This introduces jerkiness in the signal that is perceived as artifacts. By making use of the properties of speech signals, it is possible to improve upon the uniform modification technique by utilizing nonuniform modification. The idea is to compress more to those segments of little perceptual importance and compress less those segments of greater perceptual importance. Prior art use of the described idea includes transient detection and phoneme recognition. In these approaches, the scale ratio is adjusted according to the signal properties at a given time instance.

Known nonuniform time-scale compression algorithms, while offering the potential of improving the perceptual quality at low ratio, require significantly higher computational cost. Targeting on this weakness, the presently-disclosed algorithm utilizes the short-term energy of the input speech signal as guidance to adjust the scale ratio. Since a typical audio or speech signal contains segments of high and low energy, and high-energy segments play a more important perceptual role, it is possible to improve the perceptual quality by adjusting the time-scale ratio according to the energy of a particular segment. By compressing less for high-energy segments and more for low-energy or silent segments, intelligibility is enhanced.

Figure 3:
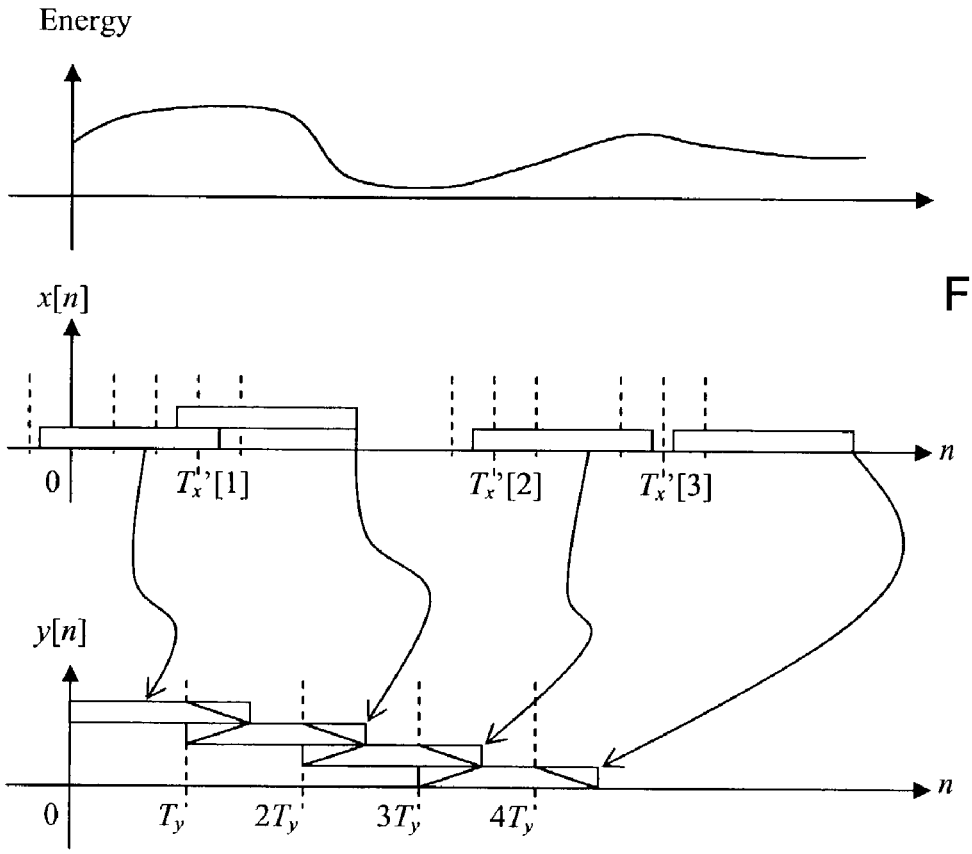
FIG. 3 illustrates nonuniform time scale compression.

The described idea is shown in one embodiment in FIG. 3, where a WSOLA-based time-scale compression algorithm is shown. The top portion of FIG. 3 illustrates energy of the input signal x[n]. The middle portion of FIG. 3 illustrates the segments of the input speech signal x[n]. This signal is segmented into nonuniform time segments $T_x'[n]$. As shown in the bottom portion of FIG. 3, the input signal x[n] is compressed by an overlap-and-add technique to form the output compressed speech signal y[n]. The objective is to find the sequence $T_x'[m]$, m=1, 2, 3, . . . for a given ratio ρ.

It is assumed that ρ (the desired time-scale ratio), $T_y$ (length of the output segments), and M (overlap length) are known. Techniques for the selection of $T_y$ and M are known or may be adapted from other sources. Here, the exemplary embodiment uses $T_y$=M=150 while dealing with narrowband speech (8 kHz sampling). The reference input segment length is therefore $$T_x=T_y/\rho \tag{2}$$

The energy is calculated from the last M samples in the mth output segment, that is, the samples used to overlap-add with the (m+1)th segment:

$$E[m]=\log\left(0.01+\sum_{n=0}^{M-1}(y[m\cdot T_y+n])^2\right) \tag{3}$$

E[m] is the energy of the signal y[n] at the interval n∈[m. $T_y$, m. $T_y$+M−1]. Note that the interval has a length of M=150 samples in the present case.

Thus, energy is found as the sum of squares of input signal samples. In this embodiment, a small positive amount (0.01) is added to the sum of squared term so as to avoid numerical problems with an all-zero sequence. Other accommodations to numerical processing and storage requirements may be made as well. For example, instead of calculating energy of the signal, a value related to the energy may be estimated. Such modifications may be readily adopted to reduce the computational load or the storage requirements, or to adapt the calculations to a particular input signal or data format.

The peak energy estimate is defined as $$E_p[m]=\max(\alpha_p.E_p[m-1],E[m],E_{p,min}) \tag{4}$$

where $\alpha_p$ is an energy peak depreciation factor and $E_{p,min}$ is the minimum energy peak level. The peak energy estimate for the current frame is selected by comparing three candidates: the previous estimate multiplied by $\alpha_p$, the current energy, and the minimum energy peak level. The factor $\alpha_p$ determines the adaptation speed and satisfies $\alpha_p<1$. $E_{p,min}$ represents the lowest possible estimate. For initialization, $E_p[0]=0$.

A bottom energy estimate is defined with $$E_b[m]=\min(\alpha_b.E_b[m-1],E[m]) \tag{5}$$

where $\alpha_b$ is an energy bottom appreciation factor, and is selected so that $\alpha_b>1$. Thus, the current bottom energy estimate is equal to the minimum of the two numbers: a scaled version of the previous estimate, and the current energy. For initialization, set $E_b[0]=\infty$.

An energy threshold is defined by $$E_{th}[m]=E_b[m]+(E_p[m]-E_b[m])/\alpha_{th} \tag{6}$$

with $\alpha_{th}>1$ the energy threshold calculation factor. Energy of the frame is compared to this threshold to decide the time-scale factor or input segmentation length of the current frame.

As explained above, the input segmentation length M is varied depending on the energy level, which implies that the time-scale ratio is not constant. The average of all these ratios, however, should be equal to the original time-scale ratio ρ, since this is a requirement of the algorithm. In order to accomplish this, a "reservoir" is introduced to keep track of the effect of time-varying input segmentation length. The reservoir sequence R[m] is initialized with R[0]=0. At the mth frame, $$R[m]=R[m-1]+T_x-T_x'[m]. \tag{7}$$

Thus, the reservoir sequence contains the accumulated surplus or shortage with respect to the reference input segment length $T_x$. Content of the reservoir and energy dictate the input segmentation length of the current frame according to the following rule:

$$T_x'[m]=\begin{cases}\alpha_1 T_x, \text{ if } E[m]>E_{th}[m] \text{ and } R[m-1]<R_{\max}\\ \alpha_2 T_x, \text{ if } E[m]<E_{th}[m] \text{ and } R[m-1]>R_{\min}\\ \theta(R[m-1])T_x \text{ otherwise}\end{cases} \tag{8}$$

where $$\theta(R)=\begin{cases}1.5 \text{ if } R>R_{\max}/2\\ 1 \text{ otherwise}\end{cases} \tag{9}$$

is a scale factor that depends on the level of the reservoir.

When the current energy is greater than or equal to the threshold ($E[m]>E_{th}[m]$) and there is enough space in the reservoir ($R[m-1]<R_{max}$ with $R_{max}$ a positive constant), $T_x'$ is set to be equal to $\alpha_1 T_x$; where $\alpha_1<1$ is selected to produce a larger time-scale ratio.

On the other hand, when the current energy is less than the threshold ($E[m]<E_{th}[m]$) and there is enough space in the reservoir ($R[m-1]>R_{min}$ with $R_{min}$ a negative constant), $T_x'$ is set to be equal to $\alpha_2 T_x$, where $\alpha_2>1$ is selected to produce a smaller time-scale ratio. For all other cases, $T_x'=T_x$ unless the reservoir is half full ($R>R_{max}/2$); in this latter case, the reservoir is drained faster so as to get ready for the next high-energy frames. This control mechanism is necessary for consistent modification of high and low energy segments.

Using the described technique, it is possible to keep track of the cumulative effect of signal modification and exert proper action so as to achieve the best signal quality and maintain at the same time an average time-scale factor that is close to the original. Successful deployment of the algorithm depends on the proper selection of various control parameters. For some embodiments, parameter selection criteria may be summarized as follows:

Energy peak depreciation factor ($\alpha_p$): Determines the adaptation speed of the energy peak estimate. Typical values are between 0.9 and 0.999.

Energy bottom appreciation factor ($\alpha_b$): Determines the adaptation speed of the energy bottom estimate. Typical values are between 1.001 and 1.1 Minimum energy peak level ($E_{p,min}$): This quantity represents the lowest possible level of the energy peak, and has influence on the manner that low-energy segments are processed.

Energy threshold calculation factor ($\alpha_{th}$): Controls the relative height of the energy threshold within the range ($E_b$, $E_p$). For $\alpha_{th}=1$, $E_{th}=E_p$; and for $a_{th}\rightarrow\infty$, $E_{th}>E_b$. Typical values are between 1.3 and 2.0.

Input segmentation length adjustment factors ($\alpha_1$, $\alpha_2$): These parameters adjust the input segmentation length, with $\alpha_1$ being associated with high-energy segments while $\alpha_2$ is associated with low-energy segments. Typical values are $\alpha_1\in[0.2, 0.8]$ and $\alpha_2\in[1.5, 2.0]$.

Reservoir limits ($R_{min}$, $R_{max}$): These parameters determine the upper and lower limits in the reservoir. If the content of the reservoir surpasses these limits, the signal is modified according to the original ratio. Otherwise, alternative ratios are used according to the current energy. Typical values are $R_{min}\in[-2000, -500]$ and $R_{max}\in[200, 1000]$.

These parameter values are exemplary only. It is important to note that the values of the parameters must be adjusted for different time-scale ratios so as to obtain the best effects. Also, different parameter values may be chosen in association with other embodiments so as to accommodate different input conditions or different output requirements. Adaptation of these exemplary embodiments to particular applications is well within the purview of those ordinarily skilled in the art.

Figure 4:
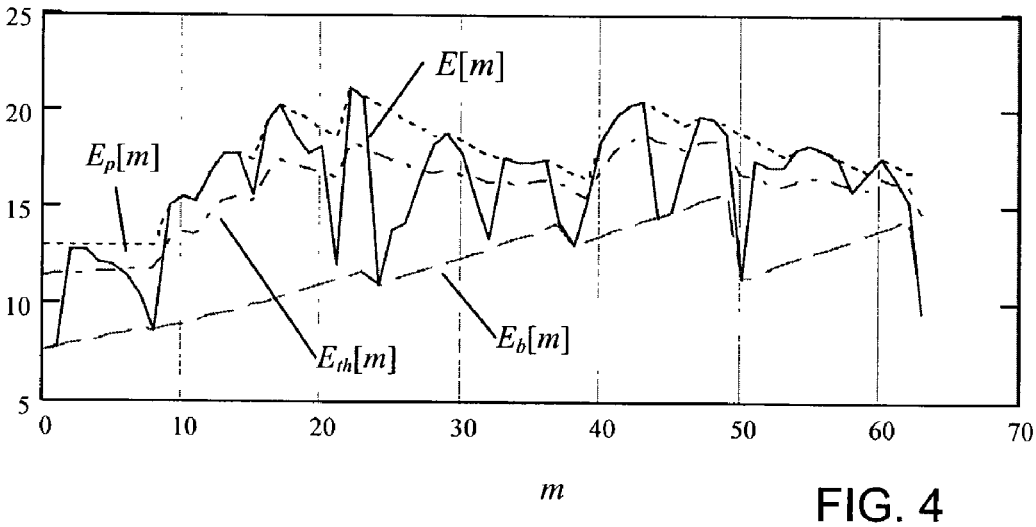
FIG. 4 illustrates control parameters for use in a time scale compression system.

The system and method described above were modeled. The model used a typical speech signal to illustrate the behavior of the algorithm. FIG. 4 shows the energy, peak energy estimate, bottom energy estimate, and energy threshold when ρ=0.3. The energy peak estimate and energy bottom estimate track the energy of the signal, with the threshold calculated based on these two estimates. The values of the parameters in this example are $\alpha_p=0.98$, $\alpha_b=1.03$, $E_{p,min}=13$, $\alpha_{th}=1.4$, $\alpha_1=0.43$, $\alpha_2=1.57$, $R_{min}=-800$, and $R_{max}=1000$.

FIG. 5 shows the sequence of input segmentation length. As can be seen, the segmentation lengths depend on the local energy, and oscillate between four values. In this example, the values are 215, 500, 750, and 785. FIG. 6 is a plot showing the content of the reservoir. The reservoir value starts from a negative value due to the initial low-energy region of the signal, and is increased as high-energy segments appear. Once the content of the reservoir is greater than the upper limit $R_{max}$, no substantial increase is allowed. In fact, the algorithm waits for low-energy segments to empty some of the content of the reservoir by compressing more. Note that at the end of processing, the reservoir is almost empty meaning that the average ratio is close to the desired value of p=0.3.

FIG. 7 shows listening test results where five subjects were asked to choose between speech signals compressed using uniform and nonuniform techniques. Four sentences (half male and half female) are used for measurement. As can be seen in FIG. 7, preference for the nonuniform algorithm increases as the time-scale ratio is reduced. For ρ=0.5 and 0.4, only slight difference is obtainable, with nonuniform compression producing a smoother sound. However, occasional distortions on the natural articulation rate happen, which lower its preference rate. Quite often, the subjects opted to not choose between the two sources since they sound close to each other.

At ρ=0.3 and 0.2, intelligibility fades away for uniform compression, with general reduction in volume and the presence of a great amount of artifacts perceived as abruptness in the sound, which confuses the speaker identity. Nonuniform compression is capable of maintaining almost the same sound volume, with smoother, more fluent sound. In addition, the modified speech sounds closer to the original since high-energy voiced segments are largely preserved, allowing a straightforward identification of the original speakers. The no preference votes dropped dramatically at these rates since a very clear distinction exist between the outcomes of the two methods.

At the extreme case of $\rho=0.1$, perception of the original message is practically lost. Most listeners prefer nonuniform compression due to the fact that the sound is still perceived as being human, and in most cases, speaker recognizability is possible. For uniform compression, the sound is highly unnatural to the degree of annoying, and the voice features of the original speaker are largely destroyed.

From the foregoing, it can be seen that a novel time-scale compression algorithm has been developed. The improvement in perceptual quality is achievable even at low time-scale ratio. The algorithm is based on estimating the energy of the signal, and uses it to decide the local ratio. To ensure that a desired time-scale ratio is obtained, a reservoir is introduced to keep track of the cumulative effect in local modification. The content of the reservoir is also taken into account to determine the local ratio. Even though the exemplary embodiments described herein are based on WSOLA, it is also possible to extend the same principles to other types of algorithm.

Time-scale compression is a key technology to enable fast review of audio-video materials. The system and method described herein have low computational overhead and hence are adequate for deployment to many practical systems. One exemplary embodiment is in a digital answering device or voice mail system, in which the disclosed embodiments or variations thereof may be used to control playback speed of recorded speech.

The disclosed system and method may be embodied as a processor or other logic device programmed to perform the calculations and other operations described above. In other applications, the system and method may be embodied software program code and data configured to perform the operations described herein, or as a computer readable storage medium such as a floppy disk or optical disk containing such a program code and data. In yet other applications, the system and method may be embodied as an electrical signal encoding the software program code and data, and the electrical may be conveyed, for example, over a network such as a local area network or the internet, and may be conveyed by wire line, wirelessly or by a combination of these.

While a particular embodiment of the present invention has been shown and described, modifications may be made. It is therefore intended in the appended claims to cover such changes and modifications which follow in the true spirit and scope of the invention.

The invention claimed is:

1. A method for processing audio data, the method comprising:

receiving data corresponding to an input audio signal;

segmenting the data into a plurality of segments;

adjusting, using a processor, a time scale ratio between the input audio signal and an output compressed audio signal according to energy of a particular segment, wherein adjusting the time scale ratio comprises varying input segmentation length for the data;

maintaining a reservoir value to track effect of the varied input segmentation length on average segment length;

determining an input segmentation length for the data based in part on the reservoir value; and providing the output compressed audio signal.

2. The method of claim 1 further comprising: estimating the energy of the segments of the data.

3. The method of claim 1 wherein adjusting the time scale ratio comprises: compressing less for relatively high-energy segments and more for relatively low-energy segments.

4. The method of claim 1 wherein segmenting the data includes segmenting based on the input segmentation length.

5. A method, comprising:

receiving data corresponding to an input audio signal;

segmenting the data into a plurality of segments;

adjusting, using a processor, a time scale ratio between the input audio signal and an output compressed audio signal according to energy of a particular segment, wherein adjusting the time scale ratio comprises:

varying input segmentation length for the data;

determining a reservoir value based on accumulated surplus or shortage with respect to a reference input segment length; and adjusting input segmentation length for the data based at least in part on the reservoir value; and providing the output compressed audio signal.

6. The method of claim 5 further comprising estimating the energy of the segments of the data.

7. The method of claim 5 wherein adjusting the time scale ratio comprises compressing less for relatively high-energy segments and more for relatively low-energy segments.

8. The method of claim 5 wherein segmenting the data includes segmenting based on the input segmentation length.

* * * * *